US008460430B2

(12) United States Patent
Baumgartner et al.

(10) Patent No.: US 8,460,430 B2
(45) Date of Patent: Jun. 11, 2013

(54) AIR QUALITY ENHANCEMENT SYSTEM

(75) Inventors: John Baumgartner, Olivia, MN (US); Matthew Baumgartner, Olivia, MN (US)

(73) Assignee: Baumgartner Environics, Inc., Olivia, MN (US)

( * ) Notice: Subject to any disclaimer, the term of this patent is extended or adjusted under 35 U.S.C. 154(b) by 473 days.

(21) Appl. No.: 12/765,315

(22) Filed: Apr. 22, 2010

(65) Prior Publication Data

US 2010/0269691 A1 Oct. 28, 2010

Related U.S. Application Data

(60) Provisional application No. 61/172,255, filed on Apr. 24, 2009.

(51) Int. Cl.
*B03C 3/34* (2006.01)

(52) U.S. Cl.
USPC ..... 95/6; 96/22; 96/94; 96/97; 119/437

(58) Field of Classification Search
USPC ..... 96/22, 94, 97; 95/6, 77; 119/437
See application file for complete search history.

(56) References Cited

U.S. PATENT DOCUMENTS

| | | | | |
|---|---|---|---|---|
| 2,209,798 | A * | 7/1940 | Subkow | 208/350 |
| 3,765,154 | A * | 10/1973 | Hardt et al. | 96/88 |
| 4,484,249 | A | 11/1984 | Saurenman | |
| 5,125,936 | A * | 6/1992 | Johansson | 96/84 |
| 5,518,531 | A * | 5/1996 | Joannu | 96/55 |
| 6,126,722 | A | 10/2000 | Mitchell et al. | |
| 6,287,368 | B1 * | 9/2001 | Ilmasti | 96/19 |
| 6,508,982 | B1 * | 1/2003 | Shoji | 422/22 |
| 6,620,224 | B1 | 9/2003 | Sato | |
| 6,872,238 | B1 | 3/2005 | Truce | |
| 2004/0141874 | A1 | 7/2004 | Mullinax | |
| 2007/0151448 | A1 * | 7/2007 | Taylor et al. | 95/57 |
| 2007/0165353 | A1 | 7/2007 | Fleischer | |
| 2007/0193444 | A1 * | 8/2007 | Hendricksen | 95/57 |
| 2011/0308384 | A1 * | 12/2011 | Baumgartner et al. | 95/6 |

FOREIGN PATENT DOCUMENTS

| | | | | |
|---|---|---|---|---|
| JP | 5-154409 | A * | 6/1993 | 96/97 |

OTHER PUBLICATIONS

Mitchell, Bailey W., and John W. Baumgartner. "Electrostatic Space Charge System for Reducing Dust in Poultry Production Houses and the Hatchery."

* cited by examiner

*Primary Examiner* — Richard L Chiesa
(74) *Attorney, Agent, or Firm* — Dicke, Billig, Czaja, PLLC

(57) ABSTRACT

A system for enhancing air quality within a poultry production facility that includes an enclosure, at least one ground plane, at least one corona point and a corona point position adjustment mechanism. The enclosure is adapted to receive a plurality of poultry. The at least one ground plane is mounted with respect to the enclosure. The corona point position adjustment mechanism enables a distance between the at least one corona point and the at least one ground plane to be adjusted.

19 Claims, 5 Drawing Sheets

AIR QUALITY ENHANCEMENT SYSTEM

REFERENCE TO RELATED APPLICATION

This application claims priority to U.S. Provisional Application No. 61/172,255, which was filed on Apr. 24, 2009, the contents of which are incorporated herein by reference.

FIELD OF THE INVENTION

The invention relates generally to a method of increasing air quality. More particularly, the invention relates to a method of increasing air quality by maintaining ionization field strength.

BACKGROUND OF THE INVENTION

Poultry production includes two major categories—meat production and egg production. Currently, most poultry produced in North America is grown under close control on highly specialized farms. The evolution from small flocks to large commercial units after World War II was facilitated by advances in the knowledge of nutrition, breeding, housing, disease control, processing of poultry and eggs, and by improvements in transportation and refrigeration that made possible distant marketing of fresh products.

Poultry produced for meat production is commonly referred to as broilers. During the last few decades, broiler production has greatly increased as a result of Americans becoming more health conscious as poultry is viewed by certain persons as healthier than other meats that are typically consumed. The increased broiler production also resulted from the increased demand for exports to other countries.

The poultry production facilities that are typically used in conjunction with commercial poultry production each contain a relatively large number of birds. For example, each poultry production facilities may house more than 20,000 birds.

The poultry production facilities confine the birds to protect them from predators and environmental extremes that would cause mortality or reduce growth, feed efficiency, immunocompetence, fertility or egg production. The poultry production facilities thereby facilitate efficiently managing a large volume of birds.

While the poultry production facilities enable a large volume of birds to be simultaneously raised, the large volume of birds generate waste materials that must be dealt with. One such material is airborne dust and biological particles.

Electrostatic precipitation of dust has been historically used to control emission from industrial smokestacks. This technique has also been used to remove dust from the air inside a living space.

When using electrostatic precipitation, ions placed into the treated airspace polarize any particles in the air. Thereafter, the polarized particles are removed from the air by attraction to a grounded collection plate.

Over time, a progressively thick layer of particles collect on the collection plate. This progressively thicker layer of particles reduces the efficiency of the electrostatic precipitation system because the layer of particles insulates the collection plate from the polarized airborne particles. To enhance the efficiency of the electrostatic precipitation system, it is necessary to periodically clean the collection plates to dislodge the accumulated particles.

Disadvantages of these types of electrostatic precipitation systems are that only a limited airspace may be treated by one collection plate. The cost and size of multiple collection plate systems reduces the feasibility of using electrostatic particle ionization in very dusty and larger air spaces.

Mitchell et al., U.S. Pat. No. 6,126,722, uses corona points to discharge negative ions into a large treated air space. This system relies on grounded surfaces inside and confining the air space to attract and hold the ionized particles.

While this system is effective at economically treating a large, dusty air space to reduce dust in the air, the polarized particles accumulate on the grounded surfaces and cause the grounded surfaces to become progressively more insulated, which decreases the efficiency of this system.

Even though manual and/or mechanical cleaning will maintain the desired ionization level, the cost and limited ability to manually or mechanically clean grounded surfaces makes such a system a less than optimal result.

SUMMARY OF THE INVENTION

An embodiment of the invention is directed to a method of improving air quality in a poultry house by maintaining ionization field strength in an electrostatic particle ionization system that is placed within the poultry production facility.

Another embodiment of the invention is directed to a system for enhancing air quality within a poultry production facility. The system includes an enclosure, at least one ground plane, at least one corona point and an ionization field strength adjustment mechanism.

The enclosure is adapted to receive a plurality of poultry. The at least one ground plane is operably mounted with respect to the enclosure. The at least one corona point is operably mounted with respect to the enclosure. The ionization field strength adjustment mechanism enables a distance between the at least one corona point and the at least one ground plane to be adjusted.

Another embodiment of the invention is directed to a system for enhancing air quality within an enclosure. The system includes at least one ground plane, at least one corona point and an ionization field strength adjustment mechanism.

The least one ground plane is operably mounted with respect to the enclosure. The least one corona point is operably mounted with respect to the enclosure. The ionization field strength adjustment mechanism enables a distance between the at least one corona point and the at least one ground plane to be adjusted.

Another embodiment of the invention is directed to method for enhancing air quality. The method includes providing an enclosure. At least one ground plane is operably mounted with respect to the enclosure. At least one corona point is operably mounted with respect to the enclosure. An ionization field strength generated between the at least one corona plate and the at least one ground plane is adjusted with an ionization field strength adjustment mechanism by changing a distance between the at least one corona point and the at least one ground plane.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

An embodiment of the invention is directed to a method to maintain ionization field strength between corona points and the ground plane in an electrostatic particle ionization system.

Increasing the electrostatic field strength will maintain the discharge of negative ions into an air space at a desired level. This technique thereby maintains the dust reduction potential of the system over a longer period of time as compared to electrostatic particle ionization systems that do not allow the field strength to be adjusted.

Figure 1:
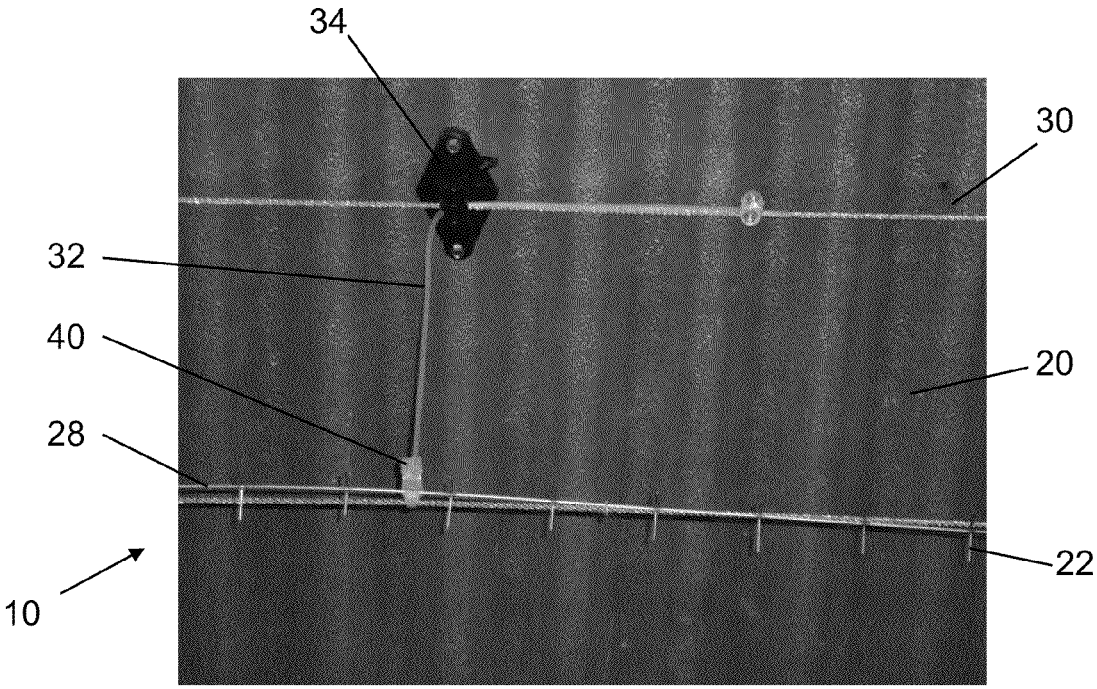
FIG. 1 is a perspective view of a corona point in an electrostatic particle ionization system.
Figure 2:
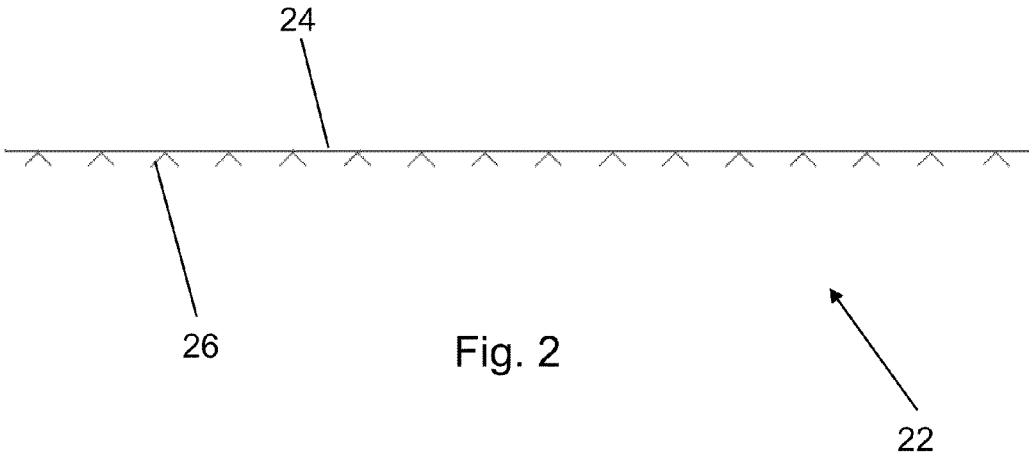
FIG. 2 is a side view of a corona point assembly for use in conjunction with the electrostatic particle ionization system.
Figure 3:
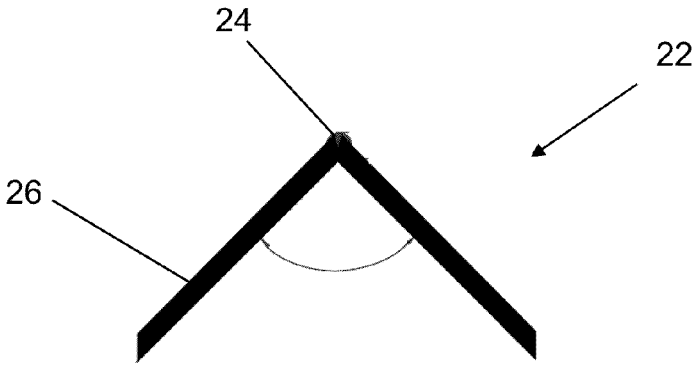
FIG. 3 is a side view of a corona point that is mounted on a spine in the corona point assembly.
Figure 4:
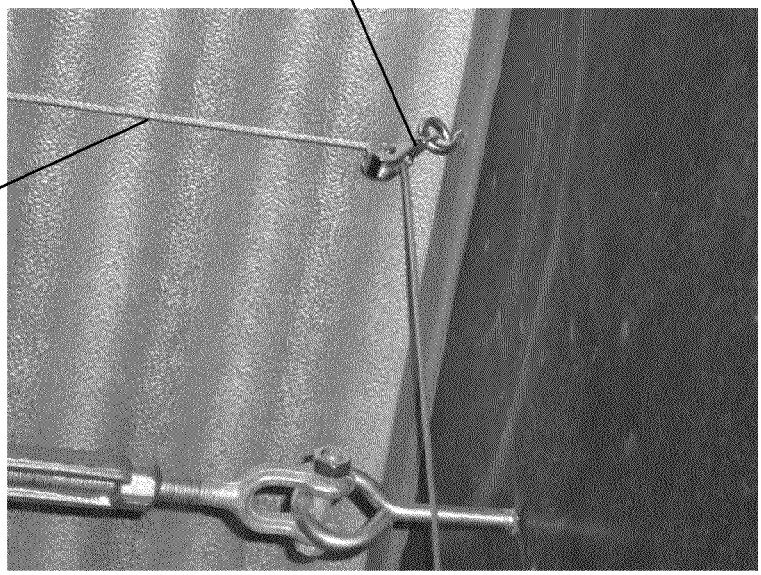
FIG. 4 is a perspective view of a height adjustment mechanism for use in conjunction with the electrostatic particle ionization system.

The electrostatic particle ionization system 10 generally includes at least one ground plane 20 and at least one corona point 22, as illustrated in FIGS. 1-3. When the electrostatic particle ionization system is used in conjunction with a poultry production facility, such as is illustrated in FIG. 4, the ground plane 20 may be incorporated into a component of the poultry production facility. In certain embodiments, the ground plane 20 may be incorporated into and/or attached to a roof of the poultry production facility.

While the ground plane 20 is illustrated in FIGS. 1-2 as being corrugated, it is possible for the ground plane 20 to take a variety of other configurations such as being substantially flat and/or being fabricated in a non-continuous array.

The ground plane 20 may be fabricated from a variety of materials using the concepts of the invention such that the ground plane 20 is capable of being charged to facilitate attracting particles to the ground plane 20.

The corona point assembly 22 includes a spine 24 and at least one corona point 26 that is mounted to the spine 24, as illustrated in FIG. 2. While the spine 24 is illustrated as being substantially linear, it is possible for the spine 24 to take a variety of other configurations. The spine 24 may be fabricated from a conductive material. An example of one such conductive material is a stainless steel rod. In certain embodiments, the stainless steel rod has a diameter of about 16 gauge.

While it is possible to form the spine 24 with very large lengths such as greater than 100 feet, in certain embodiments, the spine 24 has a length of between about 2 feet and 10 feet. In certain embodiments, a plurality of the spines 24 may be attached to a conductive wire 28, as illustrated in FIG. 1, in series to enable the system of the current invention to be used in applications that are relatively long such as having a length of more than 100 feet.

The corona points 26 may take a variety of configurations. In certain embodiments, the corona points 26 each have a generally V-shaped configuration with the legs being oriented at an angle with respect to each other of up to about 150 degrees, as illustrated in FIG. 3. In other embodiments, the legs of the corona point 26 may be oriented at an angle of about 90 degrees.

The corona points 26 may be fabricated from a variety of materials using the concepts of the invention. In certain embodiments, the corona points may be fabricated from a conductive material such as stainless steel rod. The stainless steel rod may have a diameter of about 16 gauge.

Distal ends of the corona points 26 may be tapered to a point. It is believed that the sharpness of the point at the distal ends of the corona points 26 may play an important role in the performance of the system in the current invention. A length of each of the legs of the corona point 26 may be substantially equal to each other. In certain embodiments, the corona points 26 have a length of about 0.75 inches.

A plurality of corona points 26 are attached to the spine 24. In certain embodiments, the corona points 26 are mounted in a spaced-apart relationship with respect to each other as well as a spaced-apart relationship from the ends of the spine 24. The spacing between adjacent corona points 26 may be substantially equal.

In certain embodiments, the corona points 26 are mounted at a spacing of between about 1 and 6 inches. In other embodiments, the corona points 26 are mounted at a spacing of approximately 2.275 inches. A spacing between the corona points 26 and the end of the spine 24 may be about ½ of the distance between the corona points. In certain embodiments, the spacing between the corona point 26 and the end of the spine 24 is about 1.25 inches. Utilizing the preceding dimensions, there may be 16 corona points 26 attached to a spine 24 having a length of about 36 inches.

The corona points 22 are movable mounted with respect to the ground plane 20 such that a distance between the corona points 22 and the ground plane 20 may be varied. A height adjustment system 30 may be attached to the corona points 22. The height adjustment system 30 may include a cable 32.

While the figures illustrate that the cable 32 attached to the corona points 22 at a single location, it is possible to attach the cable 32 to the corona points 22 at multiple locations to provide adequate support to the corona points 22 so that a distance between the ground plane 20 and the corona points 22 may be accurately maintained.

In the situation where the ground plane 20 is the roof of the poultry production facility, at least one guide 34 may be attached to the ground plane 20, as illustrated in FIG. 1. The at least one guide 34 is adapted to receive the cable 32. A guide 36 may also be placed proximate to an intersection of the roof and a side wall, as illustrated in FIG. 4. The guide 36 also controls the positioning of the cable 32.

Figure 5:
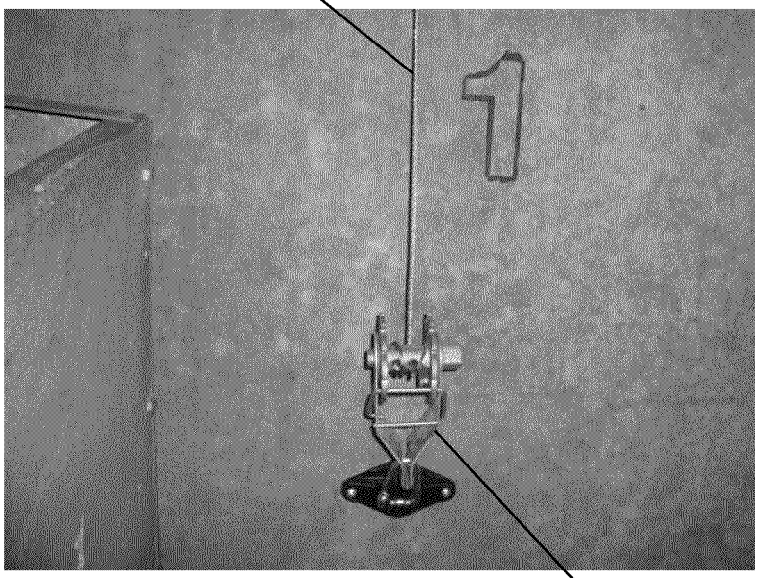
FIG. 5 is a perspective view of an adjustment mechanism for use in conjunction with electrostatic particle ionization system.

An adjustment mechanism 38 may be attached to an end of the cable 32, as illustrated in FIG. 5. The adjustment mechanism 38 may be attached to the side wall at a height that facilitates a person activating the adjustment mechanism 38 while standing on the ground.

The adjustment mechanism 38 may take a variety of forms using the concepts of the invention. In certain embodiments, the adjustment mechanism 38 is a ratchet that is operable in a wind mode, an unwind mode and a lock mode.

A distance between the corona points 22 and the ground plane 20 may be varied using the adjustment mechanism 38 to maintain a desired amperage in the electrostatic particle ionization system that is monitored using an amperage monitoring mechanism, which is operably associated with the adjustment mechanism 38. In certain embodiments, the distance between the corona points 22 and the ground plane 20 may be between about 6 inches and 12 inches.

The components of the height adjustment mechanism 30 may be electrically insulated from the corona points 22. In certain embodiments, the electric insulating may be provided by a polypropylene or TEFLON spacer 40.

While an electrical current may be used in conjunction with the concepts of the invention, the electrical current may be provided with a high voltage and a low amperage to minimize potential of health hazards associated with electrical shock. In certain embodiments, the amperage used in this system may be on the order of milliamps.

The amperage of an electrostatic particle ionization system inside a clean room air space may vary based upon a variety of factors. An example of such factors includes the length of a corona point run. These factors are typically known at the outset of the ionization period.

As dust collects on the ground plane 20 and begins to progressively insulate the grounded surface from the corona point run, the amperage drawn will begin to decrease.

To compensate for the decrease in amperage, the electrostatic particle ionization system of this invention enables the corona point run 22 to be moved closer to the ground plane 20. By moving the corona points 22 closer to the ground plane 20, the strength of the electrostatic field will be increased, which will cause the amperage to increase. Using this technique, the ionization potential of the system can be maintained at the original amperage level.

While the system illustrated in the figures is manually adjusted, it is also possible to configure the electrostatic particle ionization system for automatic adjustment. In certain embodiments, the automated system may continually adjust the distance between the corona point 22 and the ground plane 20 to maintain the desired amperage reading.

Virtually all airborne particles have a positive charge. These positively charged particles are attracted to negatively charged particles. When this process occurs, the particles become polarized. These polarized particles are attracted to each other and to grounded surfaces.

This process thereby removes the airborne particles from the air and prevents inhalation into the respiratory tract where infection can occur. When infection happens, diseases are spread, health problems are triggered and the immune systems of the persons, animals or birds who inhale these materials are weakened.

The air quality is enhanced because the electrostatic particle ionization system reduces levels of dust, particles, ammonia and hydrogen sulfide in the air. The negative ions interfere with the cellular functions of microbes. This disruption may kill a microbe and thereby eliminates the potential of the microbe infecting the birds or the persons working in the poultry production facility.

The benefits of the use of the concepts of the current invention are illustrated in photographs 4-7. FIG. 4 is a photograph of an interior portion of a poultry production facility that contains the system for enhancing air quality. FIG. 5 is a photograph of an interior portion of a poultry production facility that does not contain the system for enhancing air quality.

As evidenced by these figures, the poultry production facility that does not contain the system for enhancing air quality has a considerably higher level of airborne dust when compared to the poultry production facility that contains the system for enhancing air quality.

Figure 6:
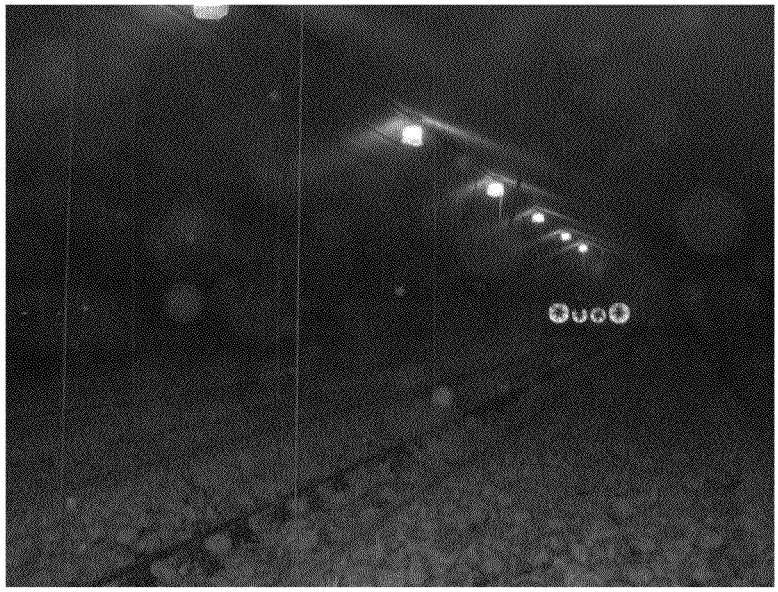
FIG. 6 is a photograph of an interior region of a poultry production facility that contains the electrostatic particle ionization system.
Figure 7:
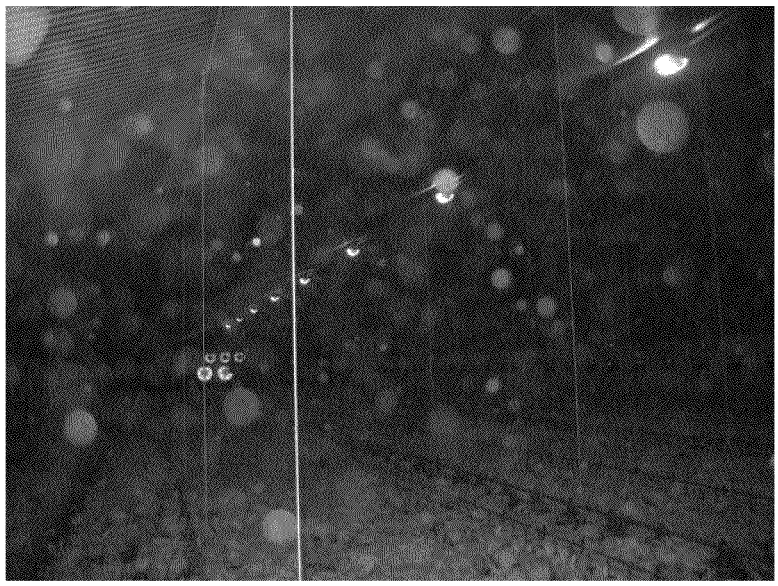
FIG. 7 is a photograph of an interior portion of a poultry production facility that does not contain the electrostatic particle ionization system.
Figure 8:
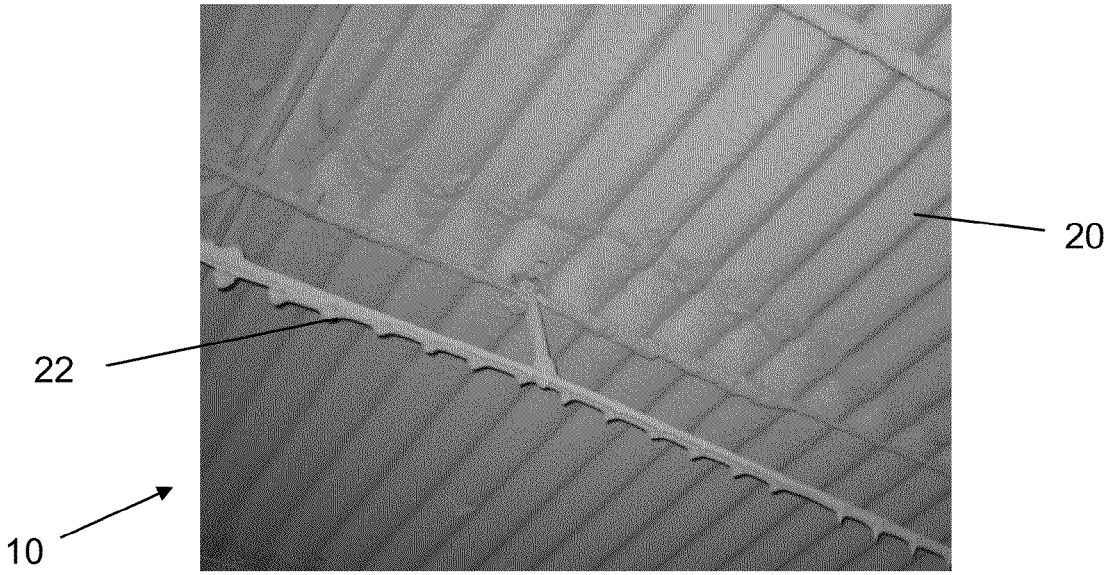
FIG. 8 is a photograph of a lower surface of the roof of the poultry production facility of FIG. 6.
Figure 9:
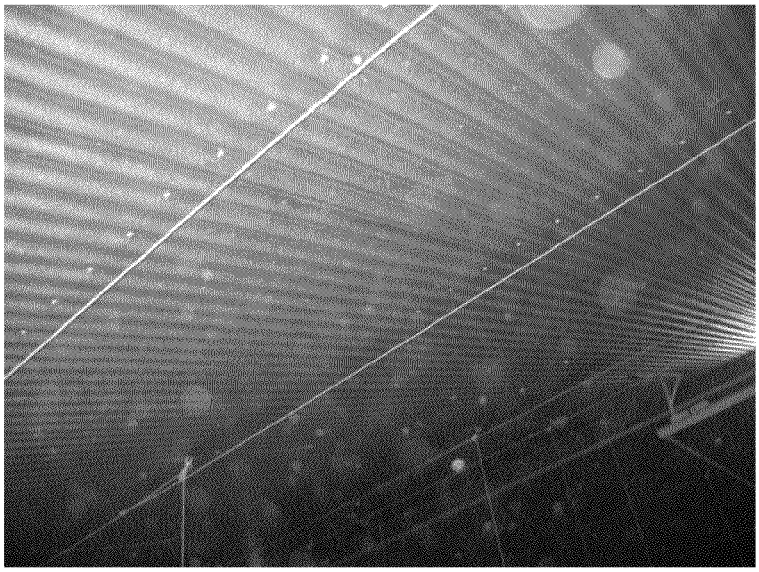
FIG. 9 is a photograph of a lower surface of the roof of the poultry production facility of FIG. 7.

Additionally, FIGS. 6 and 7 that are photographs of the lower surface of a ceiling in the poultry production facility that do contain and do not contain the system for enhancing air quality, respectively. The ceiling of the poultry production facility that contains the system for enhancing air quality has a significant dust layer (FIG. 6) while the ceiling in the poultry production facility that does not have the system for enhancing air quality has a much lower level of dust (FIG. 7).

While the high dust and biological particle concentrations inside of a poultry production facility will particularly benefit from the use of the system for enhancing air quality and the associated methods of the current invention, it is possible for other buildings that contain dust and biological particles to benefit from the use of the system for enhancing air quality and the associated methods of the current invention.

Yet another benefit of the invention is a reduction in the ventilation costs. In many conventional ventilation systems, a fan draws air into the poultry production facility and an exhaust port is provided where the particulate laden air is exhausted outside of the poultry production facility. Such a process could lead to environmental contamination from the dust and biological particles in the particulate laden air. Additionally, in areas where the ambient temperature is too low or too high for optimal growth of the birds, such replacement air must be heated or cooled at a significant cost.

It is possible to adapt the concepts of the invention for use in applications other than poultry for use in conjunction with other livestock such as swine, which generate a significant level of airborne particles. It is possible to adapt the concepts of the invention for use inside other structures that have high levels of airborne particles, an example of one such structure is in a welding shop.

Additionally, it is possible to employ the concepts of the invention in areas that are not confined within an enclosure. Examples of such other applications include outdoor activities that generate dust and/or biological particles.

In addition to enhancing the air quality for persons working within the poultry production facility, it has been recognized that the enhanced air quality within the poultry production facility may also increase the productivity of poultry production when compared with poultry houses that do not offer the birds the enhanced air quality.

A few factors by which the increase in the poultry production productivity may be measured are the efficiency of feed conversion and the total body mass of the poultry produced within a particular period of time. Even a relatively low increase of in the range of 3-4 percent can provide the financial justification to warrant installation of the system for enhancing air quality discussed herein.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A system for enhancing air quality within a poultry production facility, wherein the system comprises:

an enclosure that is adapted to receive a plurality of poultry;

at least one ground plane operably mounted with respect to the enclosure;

at least one corona point operably mounted with respect to the enclosure; and an ionization field strength adjustment mechanism that comprises:

an amperage monitoring mechanism that is capable of monitoring amperage drawn by the air quality enhancement system; and a distance adjustment mechanism that is capable of changing a distance between the at least one corona point and the at least one ground plane based upon a change in the monitored amperage from the amperage monitoring mechanism.

2. The air quality enhancement system of claim 1, wherein the ionization field strength adjustment mechanism enables a relatively constant ionization field strength to be provided between the at least one corona point and the at least one ground plane for removal of airborne particles from within the enclosure.

3. The air quality enhancement system of claim 2, wherein amperage draw decreases in response to insulation of the at least one ground plane caused by collection of the airborne particles on the at least one ground plane.

4. The air quality enhancement system of claim 1, wherein the at least one ground plane is incorporated into the enclosure.

5. The air quality enhancement system of claim 1, wherein the at least one ground plane and the at least one corona point are fabricated from a conductive material.

6. The air quality enhancement system of claim 1, wherein the at least one corona point is provided in a corona point assembly that further comprises a spine to which the at least one corona point is mounted.

7. The air quality enhancement system of claim 6, wherein the at least one corona point comprises a plurality of corona points and wherein the plurality of corona points are mounted in a spaced-apart configuration on the spine.

8. A system for enhancing air quality within an enclosure, wherein the system comprises:

at least one ground plane operably mounted with respect to the enclosure;

at least one corona point operably mounted with respect to the enclosure; and an ionization field strength adjustment mechanism that comprises:

an amperage monitoring mechanism that is capable of monitoring amperage drawn by the air quality enhancement system; and a distance adjustment mechanism that is capable of changing a distance between the at least one corona point and the at least one ground plane based upon a change in the monitored amperage from the amperage monitoring mechanism.

9. The air quality enhancement system of claim 8, wherein the ionization field strength adjustment mechanism enables a relatively constant ionization field strength to be provided between the at least one corona point and the at least one ground plane for removal of airborne particles from within the enclosure.

10. The air quality enhancement system of claim 9, wherein amperage draw decreases in response to insulation of the at least one ground plane caused by collection of the airborne particles on the at least one ground plane.

11. The air quality enhancement system of claim 8, wherein the at least one ground plane is incorporated into the enclosure.

12. The air quality enhancement system of claim 8, wherein the at least one ground plane and the at least one corona point are fabricated from a conductive material.

13. The air quality enhancement system of claim 8, wherein the at least one corona point is provided in a corona point assembly that further comprises a spine to which the at least one corona point is mounted.

14. The air quality enhancement system of claim 13, wherein the at least one corona point comprises a plurality of corona points and wherein the plurality of corona points are mounted in a spaced-apart configuration on the spine.

15. A method for enhancing air quality, wherein the method comprises:

providing an enclosure;

operably mounting at least one ground plane with respect to the enclosure;

operably mounting at least one corona point with respect to the enclosure;

delivering electric current to the at least one corona point;

monitoring amperage of the delivered electric current; and changing a distance between the at least one corona point and the at least one ground plane with an ionization field strength adjustment mechanism based upon the monitored amperage of the electric current to adjust an ionization field strength generated between the at least one corona plate and the at least one ground plane.

16. The air quality enhancement method of claim 15, wherein the ionization field strength adjustment mechanism enables a relatively constant ionization field strength to be provided between the at least one corona point and the at least one ground plane for removal of airborne particles from within the enclosure.

17. The air quality enhancement method of claim 16, wherein amperage draw decreases in response to insulation of the at least one ground plane caused by collection of the airborne particles on the at least one ground plane.

18. The air quality enhancement method of claim 15, and further comprising mounting the at least one corona point on a spine.

19. The air quality enhancement method of claim 18, wherein the at least one corona point comprises a plurality of corona points and wherein the plurality of corona points are mounted in a spaced-apart configuration on the spine.

* * * * *